US009603393B2

(12) United States Patent
Crye

(10) Patent No.: US 9,603,393 B2
(45) Date of Patent: Mar. 28, 2017

(54) PERSONAL LOAD DISTRIBUTION DEVICE

(71) Applicant: Caleb Clark Crye, Brooklyn, NY (US)

(72) Inventor: Caleb Clark Crye, Brooklyn, NY (US)

(73) Assignee: LINEWEIGHT LLC, Brooklyn, NY (US)

( * ) Notice: Subject to any disclaimer, the term of this patent is extended or adjusted under 35 U.S.C. 154(b) by 0 days.

(21) Appl. No.: 14/887,077

(22) Filed: Oct. 19, 2015

(65) Prior Publication Data

US 2016/0069647 A1 Mar. 10, 2016

Related U.S. Application Data

(63) Continuation of application No. 12/826,249, filed on Jun. 29, 2010, now Pat. No. 9,185,964.

(60) Provisional application No. 61/222,097, filed on Jun. 30, 2009.

(51) Int. Cl.

| | |
|---|---|
| ***A41D 13/00*** | (2006.01) |
| ***A45F 3/04*** | (2006.01) |
| ***A45F 3/06*** | (2006.01) |
| ***A45F 3/14*** | (2006.01) |
| ***F41H 1/02*** | (2006.01) |

(52) U.S. Cl.

CPC ..... *A41D 13/0012* (2013.01); *A41D 13/0007* (2013.01); *A45F 3/04* (2013.01); *A45F 3/047* (2013.01); *A45F 3/06* (2013.01); *A45F 3/14* (2013.01); *F41H 1/02* (2013.01); *A41D 2400/48* (2013.01)

(58) Field of Classification Search

CPC ..... A41D 1/04; A41D 1/002; A41D 13/012; A45F 3/04; A45F 2003/045; A45F 3/06; A45F 3/08; A45F 3/14; A45F 2003/142

See application file for complete search history.

(56) References Cited

U.S. PATENT DOCUMENTS

| | | | |
|---|---|---|---|
| 204,066 | A | 5/1878 | Merriam |
| 3,114,486 | A | 12/1963 | Flexman |
| 3,409,007 | A | 11/1968 | Fuller |
| 3,840,902 | A | 10/1974 | McNeill |
| 4,179,053 | A | 12/1979 | Figura |
| 4,425,667 | A | 1/1984 | Harrison |

(Continued)

FOREIGN PATENT DOCUMENTS

| | | | |
|---|---|---|---|
| CA | 2495126 | A1 | 7/2006 |
| FR | 2700677 | * | 1/1993 |

(Continued)

OTHER PUBLICATIONS

International Preliminary Report on Patentability for PCT/US2010/0040422 dated Oct. 19, 2011.

(Continued)

*Primary Examiner* — Shaun R Hurley
*Assistant Examiner* — Andrew W Sutton
(74) *Attorney, Agent, or Firm* — Stiennon & Stiennon

(57) ABSTRACT

Support assemblies releasably extending between a ballistic vest and a waist encircling belt transfer the loads from the vest to the belt relieving the stress on the wearer's shoulders and spine. Each support assembly has a stiff carbon fiber bar enclosed within webbing which is attached to a side section of the vest such as by extending within a downwardly opening pocket, and is attached to the belt such as by an upwardly opening pocket.

16 Claims, 4 Drawing Sheets

(56) References Cited

U.S. PATENT DOCUMENTS

| | | | |
|---|---|---|---|
| 5,564,612 | A | 10/1996 | Gregory |
| 5,890,640 | A | 4/1999 | Thompson |
| 5,984,157 | A | 11/1999 | Swetish |
| 6,199,732 | B1 | 3/2001 | Swetish |
| 6,837,409 | B2 | 1/2005 | Lemanski, II |
| 2003/0121945 | A1 | 7/2003 | Lemanski, II |
| 2004/0007605 | A1 | 1/2004 | Mares |
| 2005/0045687 | A1 | 3/2005 | Willows et al. |
| 2005/0082330 | A1 | 4/2005 | Fehlberg et al. |
| 2006/0011689 | A1 | 1/2006 | Reid |
| 2006/0113344 | A1 | 6/2006 | Cragg |
| 2006/0151559 | A1 | 7/2006 | Gravseth |
| 2007/0074327 | A1 | 4/2007 | Davies et al. |
| 2007/0079415 | A1 | 4/2007 | Carlson |
| 2007/0251965 | A1 | 11/2007 | Mosley |
| 2007/0289045 | A1 | 12/2007 | Evans et al. |
| 2008/0010730 | A1 | 1/2008 | Twito et al. |
| 2008/0245835 | A1 | 10/2008 | Reid |
| 2009/0212081 | A1 | 8/2009 | Liang et al. |
| 2009/0236378 | A1 | 9/2009 | Crye |
| 2010/0281607 | A1 | 11/2010 | Kordecki |
| 2012/0192335 | A1 | 8/2012 | Crye |

FOREIGN PATENT DOCUMENTS

| | | | |
|---|---|---|---|
| FR | 2700677 | A1 | 7/1994 |
| WO | 2011002784 | A1 | 1/2011 |

OTHER PUBLICATIONS

International Search Report for PCT/US2010/0040422 dated Sep. 21, 2010.

Written Opinion of the International Searching Authority for PCT/US2010/0040422 dated Sep. 21, 2010.

Extended European Search Report for PCT/US2010/040422 dated Nov. 15, 2013.

* cited by examiner

PERSONAL LOAD DISTRIBUTION DEVICE

CROSS REFERENCES TO RELATED APPLICATIONS

This application is a continuation of U.S. application Ser. No. 12/826,249, filed Jun. 29, 2010, which claims the benefit of U.S. provisional App. No. 61/222,097, filed Jun. 30, 2009, the disclosures of both of which application are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to load-carrying supports in general, and more particularly to support systems which allow wearers to more adequately carry loads for extended periods.

Soldiers and police officers, when in a position of harm from small arms, rifle fire, or shrapnel, can counter these hazards by wearing protective clothing. Ballistic armor vests and jackets can incorporate so-called "soft armor" for protection against low velocity projectiles such as handgun rounds, fragmentation rounds from a grenade or mortar, and miscellaneous shrapnel. Soft armor is composed of assemblies of ballistic fabric such as those formed from DuPont Kevlar® fibers. The soft armor is often fabricated as flexible panels which are received within pockets or pouches formed in fabric vests or jackets, which may have a shape-supporting molded plastic sheet such as those disclosed in U.S. Pat. No. 6,892,392 to an Integrated Personal Body Armor, the disclosure of which is incorporated by reference herein. In more serious threat situations, where higher velocity rifle rounds must be countered, soft armor has typically been supplemented with hard armor fabricated of rigid plates of ceramic, polymer, or metal.

As the level of protection increases, the armor will typical be heavier. In addition, the armored vest may serve as a carrier for ancillary equipment, adding additional weight. Conventionally, the full weight of the wearer's vest is borne by his shoulders. However, any load applied to the shoulders is ultimately transferred to the spine. Since protective armor vests are worn for long periods of time and during strenuous activity, this pressure on the shoulders and ultimately the spine is undesirable. Moreover, the prolonged strain of carrying these loads on the wearer's shoulders can reduce the wearer's effectiveness at whatever job he is performing, with increased metabolic cost, accelerated fatigue, and pain.

On the other hand, permanent connections might transfer loads to the user's waist but which would unduly hamper movement most be avoided in military and police work, where it is necessary to take up an active position on very short notice.

In U.S. Publication No. US-2005-0082330-A1 to a Pack Support with Frictional Load Transfer, a high friction engagement is defined between a backpack and a special belt which transfers loads to the wearer's waist in certain conditions, but allows the connection to be rapidly separated when the wearer takes on an active position.

What is needed is a carrier system which aids a user wearing a heavy garment for extended periods.

SUMMARY OF THE INVENTION

The load-carrying assembly of the present invention employs stiff bars to transfer the loads from a ballistic vest to a waist-encircling belt. Support assemblies are centered on each side of the wearer, and are flexibly connected to the vest and the belt, for example by engaging the PALS loops of the vest, and by a connection to a belt mount. When the wearer stands upright, with the belt properly tightened and at an appropriate height, the loads on the wearer's shoulders are transferred to the waist, relieving back stress. The attachment to the vest may be by the end of a bar being received within a downwardly opening pocket on the vest, or by a cord woven between the PALS loops on the vest and a series of horizontally-opening loops sewn to the stiff carbon fiber bars. Alternatively, various snap or buckle arrangements can be used where appropriate, or sidewardly projecting shelves may be fastened to the belt.

It is an object of the present invention to provide support assemblies to transfer loads carried on a ballistic vest to a waist-encircling belt.

It is another object of the present invention to provide load transferring equipment for ballistic vests which is readily disconnected.

Further objects, features and advantages of the invention will be apparent from the following detailed description when taken in conjunction with the accompanying drawings.

DESCRIPTION OF THE PREFERRED EMBODIMENTS

Figure 3:
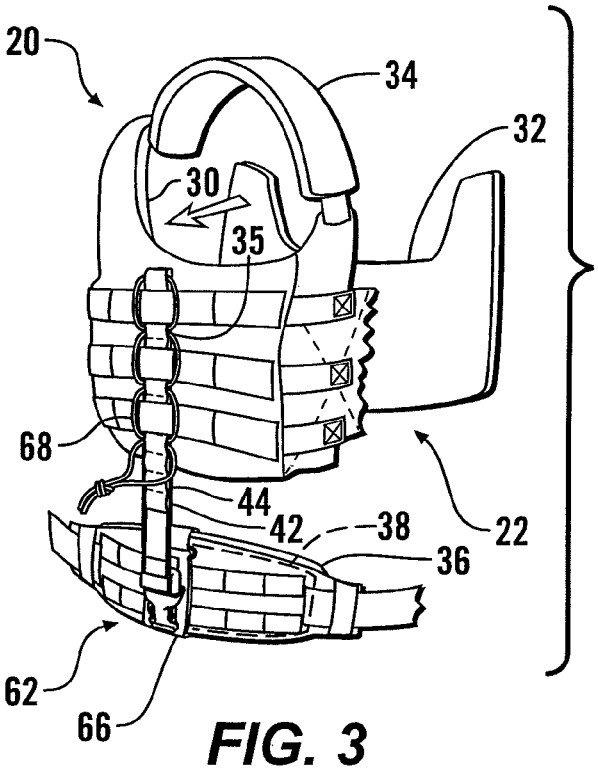
FIG. 3 is a perspective view, partially broken away and exploded of a load carrying assembly of this invention employing the support assembly of FIGS. 1 and 2.
Figure 5:
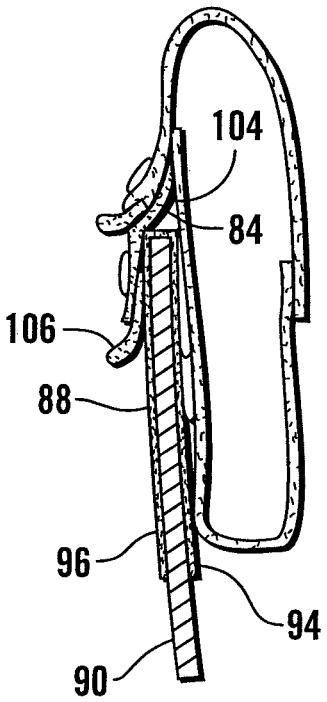
FIG. 5 is a fragmentary cross-sectional view of the support assembly of FIG. 4 showing the support bar extending within one of a plurality of downwardly opening pockets on a vest.
Figure 6:
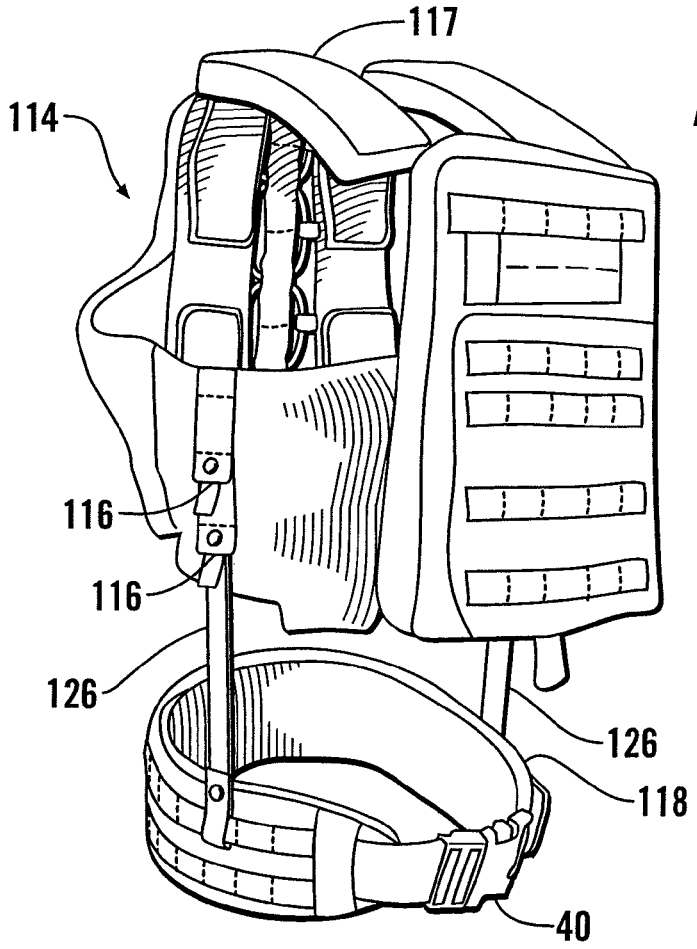
FIG. 6 is a perspective view of an alternative load carrying assembly of this invention, in which the support bars are engaged within upwardly opening pockets on the belt.

Referring more particularly to FIGS. 1-9, wherein like numbers refer to similar parts, a load carrying assembly 20 is shown in FIG. 3. The load carrying assembly 20 may include a conventional ballistic vest 22 such as the CAGE Armor Chassis™ manufactured by Crye Precision LLC of Brooklyn, N.Y., or the vest disclosed in U.S. Pat. No. 8,353,065, entitled Configurable Body Armor, the disclosure of which is incorporated by reference herein. The vest 22, as shown in FIGS. 3 and 6 has a rear section 24 and a front section 26 spaced frontwardly of the rear section. The front and rear sections may include armor plates. A left side section 28 and a right side section 30 extend between the rear section 24 and the front section 26. The left and right side sections 28, 30 may each be provided with a side ballistic insert 32 comprised of multiple layers of ballistic fabric together with a molded plastic sheet formed into a continuous generally concave bent sheet element which opens towards the opposing vest section. The side ballistic insert 32 is received within an interior pocket of the side vest section. The ballistic insert 32 gives a degree of stiffness to the vest side sections 28, 30. The rear section 24 and the front section 26 are connected to the side sections, and the loads of the ballistic inserts, hard armor, or other loads worn on the front or rear of the vest can be transferred to the left and right side sections. Each side section 28, 30 has a shoulder section 34 through which the loads of the vest are usually transferred to the shoulders of the person wearing the vest. The vest 22 is preferably provided with horizontal rows of 1" Mil-W-43668 Type III nylon webbing spaced 1" apart, and reattached to the backing at 1.5" intervals, as in the U.S. Army's PALS (Pouch Attachment Ladder System) arrangement. For example, the vest side sections may have three rows of PALS webbing. The PALS webbing defines an array of upwardly and downwardly opening loops 35.

The load carrying assembly 20 also includes a waist-encircling belt 36 which may be the BLAST Belt™ manufactured by Crye Precision LLC of Brooklyn, N.Y., or the belt disclosed in U.S. Pat. No. 8,397,312 entitled Supplemental Body Armor Component, the disclosure of which is incorporated by reference herein. The belt 36 may be provided with an internal stiffening element 38 which may be soft or hard armor. The belt 36, may have a front buckle 40, similar to the one shown in FIG. 6, and is adjustable to securely engage the waist of a wearer at a desired height.

Figure 1:
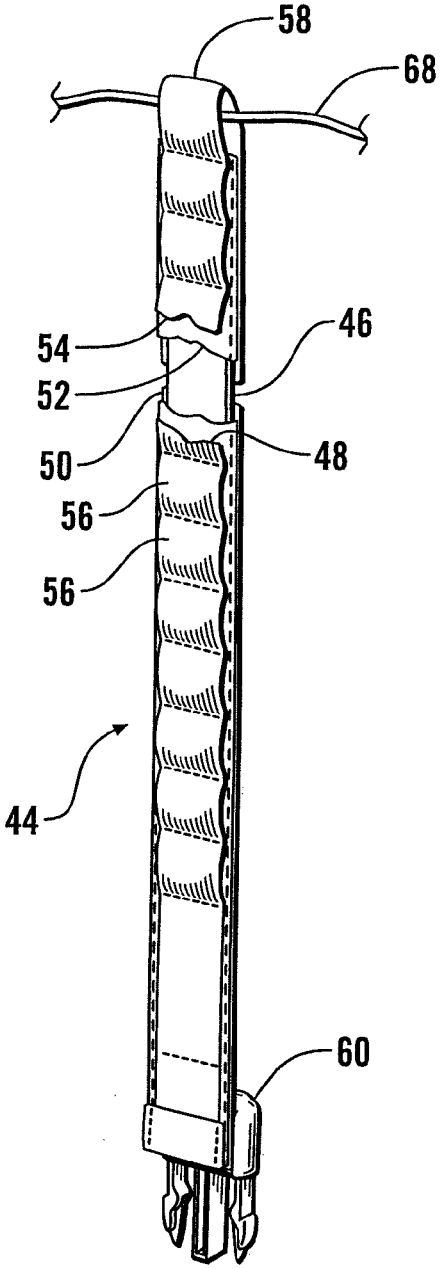
FIG. 1 is a perspective view, partially broken away, of a bar assembly of a support assembly of this invention.
Figure 2:
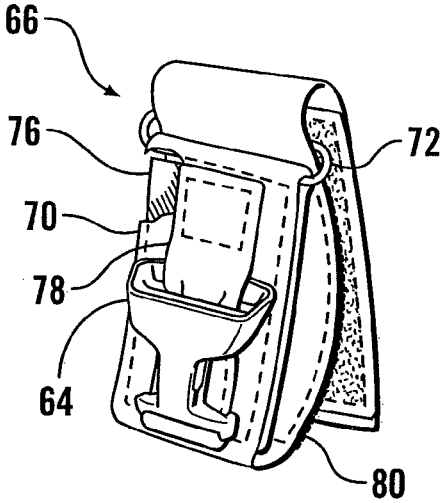
FIG. 2 is a perspective view of a belt mount and female buckle end of a support assembly of this invention.
Figure 4:
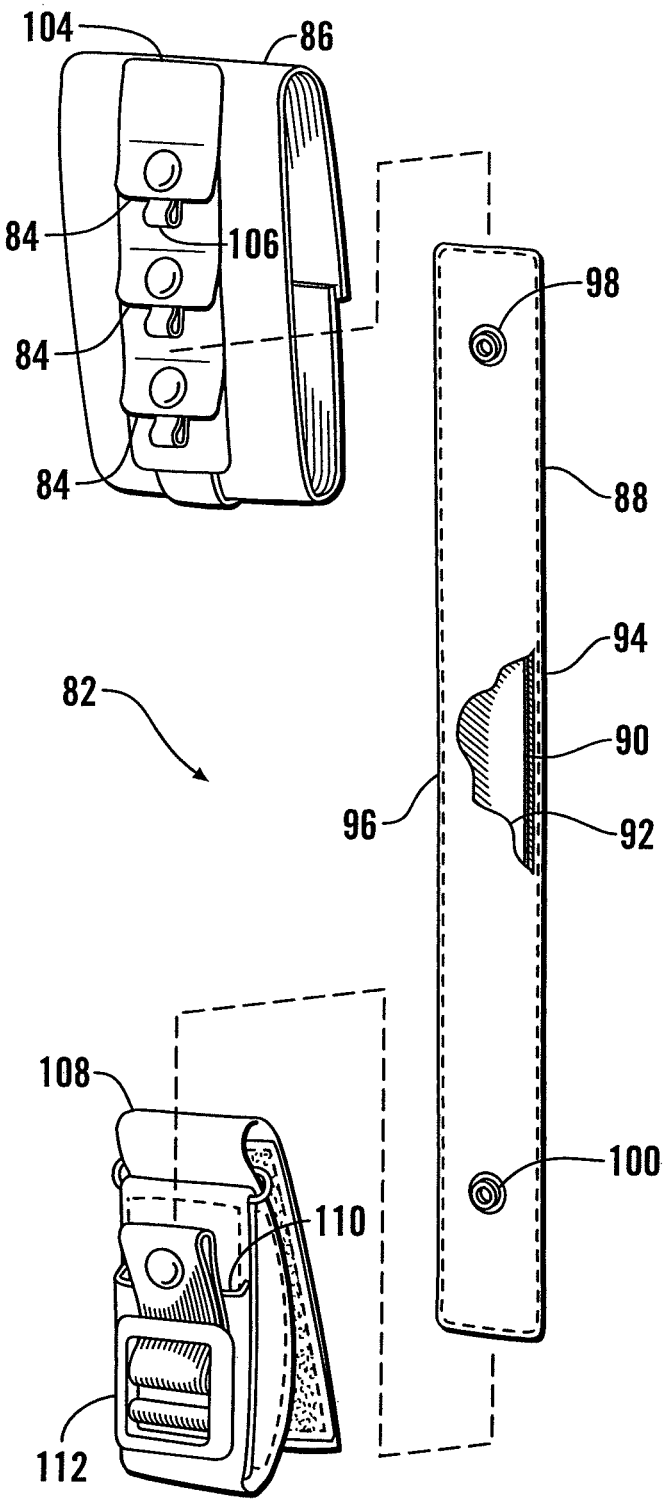
FIG. 4 is an exploded perspective view, partially broken away in section of an alternative embodiment support assembly of a load carrying assembly of this invention.

Two support assemblies 42 extend between and connect the vest 22 to the belt 36. A support assembly 42 is connected between the right side section 30 of the vest and the belt 26, and an identical support assembly, not shown, is connected between the left side section 28 of the vest and the same belt. The weight of the heavy vest is supported by the wearer's belt by this connection between the vest and belt. Each support assembly 42, as shown in FIGS. 1-3, has a stiff bar assembly 44 having a stiff support bar 46 which is received within a pocket 48 defined between an inner strip of webbing 50 and an outer strip of webbing 52 which are stitched together. The stiff support bar 46 may be a unitary rectangular sheet of very rigid carbon fiber material, about ⅛ inch thick, and one inch wide by twelve inches tall. A loop forming strip of webbing 54 is sewn to the outer strip of webbing 52 to define a plurality of sidewardly opening loops 56 which are spaced one above the other, and terminated at the top of the bar assembly by a top loop 58.

The bar assembly 44 is terminated at its lower end by a male end 60 of a two-part buckle assembly 62. The buckle assembly 62 may be a plastic side release buckle assembly, with the female shell end 64 being affixed to a belt mount 66 which is connected to the belt 36. As best shown in FIG. 1, the buckle male end 60 has a plurality of deflectable tongues which engage within the female shell end 64. The buckle assembly 62 provides convenient and rapid connection and disconnection requiring only a single hand.

The bar assembly 44 may be connected to the vest in a variety of fashions, as described in more detail below. In the embodiment shown in FIGS. 1 and 3, the bar assembly 44 is inserted within a column of PALS loops 35 and arranged at the desired height on the vest, then a flexible cord 68 is threaded through the sidewardly opening loops 56 of the bar assembly. The cords may have a heat shrunk tip to facilitate threading. Additionally, a threading tool may be employed. The bar assembly loops 56 may be spaced only about one half inch apart, making it possible to adjust the location of the bar assembly in one half inch increments. The cord 68 passes through the top loop 58 on the bar assembly 44, and is then tied off after passing through the bar assembly loop 56 beneath the lowest of the PALS loops 35 on the vest. The loops 35 on the vest 22, the loops 56, 58 on the bar assembly, and the cord 68 define an upper attachment of the support assembly 42 to the vest. It should be noted that the lower attachment of the bar assemblies to the belt could also be a similar cord and loop attachment.

As shown in FIG. 2, the belt mount 66 has a strip of webbing 70 which is folded to enclose an upper ring 72 and sewn to itself with a stiffening plastic sheet 76 between the two layers of the webbing, producing a stiffened base for an attachment webbing strip 78 to mount the female shell end 64 of the buckle assembly 62. The strip of webbing 70 extends beneath the female shell end 64 and passes behind the belt 36 and passes through the upper ring 72 and then is folded back onto itself. The webbing strip 70 is provided with two-part hook and loop fastener 80, such as VELCRO® fastener manufactured by Velcro Industries B.V. The strip of webbing 70 can thus be adjusted and the hook and loop fastener secured in place to fix the belt mount 66 in a desired location to the belt 36. A belt mount 66 is positioned on the belt directly below the bar assemblies 44 on each side of the wearer, and the belt mount with the female end shell defines a lower attachment of the support assembly 42.

In use the wearer of the load carrying assembly 20 will adjust two support assemblies 42 to effectively transfer loads carried on the vest 22 to the belt 36. If the bar assemblies 44 are too far forward, the load transfer does not take place until the wearer bends, or if the wearer leans in one direction. Therefore the bar assemblies should be in the middle of the wearer and on each side. This positioning of the bar assemblies along the wearer's midline helps to reduce the extent to which the distance changes between the vest and the belt at the location of the bar assemblies when the wearer bends.

It will be noted that the connections between the bar assemblies 44 to the vest 22 and to the belt 36 are all fabric-based, which inherently gives a flexible connection. In particular, the connection between the buckle assembly 62 and the bar and the belt mount 66 has flex and bending built into it. Although a simple and low cost connection mechanism, these connections give the wearer the ability to achieve load transfer in a very natural fashion. If the wearer's hips are maintained straight, with feet planted, even when the upper body is twisted, the bars pivot, and the load is still transferred. Moreover, the support assemblies 42 are very well adapted to be retrofitted to existing equipment to add the load-transference properties.

It should be further noted that by wrapping the carbon fiber support bar 46 in fabric, such as the inner and outer strips of webbing 50, 52, the wearer is protected from any splinters or sharp edges should the carbon fiber bar 46 break, as the surrounding fabric webbing holds the splinters and other fragments together. In addition, the bar assemblies 44 may be supplied in various lengths to accommodate wearers of different heights.

By translating the weight to the hips, the load is sent straight through the pelvic bone to the legs. This isolates the shoulders and spine from the load and thereby keeps the wearer from suffering the negative effects of supporting weight on one's shoulders/spine.

The belt 36 preferably has a taper fit over the hips, in order to go down it will tend to compress the hips. To resist the downward force of the loads applied, the belt will be tightened. A vest with armor can weigh from fifteen to seventy pounds. This load will require the belt to be quite tight, but this is preferable in most cases to the loads being applied to the shoulders. Moreover, if desired the wearer can shift the weight back to the shoulders by lowering or loosening the belt.

The attachment of the support assemblies 42 to the belt 36 and the vest 22 are such that when the emergency doff mechanisms of the vest are used, the belt and vest remain connected until the support assemblies 42 are separated from the belt 36 by disengaging the buckle assemblies 62. However, by retaining the engagement between the support assemblies, the vest and the belt, the entire load carrying assembly 20 can be rapidly donned. If it is desired that the vest and belt not be connected upon actuation of the vest's emergency doff mechanism, an alternative embodiment 82 of the invention may be employed, such as the one shown in FIGS. 4 and 5.

The load carrying assembly 82 has a plurality of downwardly opening pockets 84 which may be sewn directly to the ballistic vest 86, as shown, or which may be mounted to a sleeve or substrate for mounting to the PALS webbing of a conventional vest. The wearer can select the appropriate pocket 84 to suit the length of bar assembly 88 which is available. The bar assembly 88 has a stiff support bar 90 which may be formed of carbon fiber, and which is sewn within a pocket 92 defined between an inner strip of webbing 94 and an outer strip of webbing 96. An upper snap male half 98 is affixed to the outer strip of webbing 96 near the top of the bar assembly 88, and a lower snap male half 100 is affixed to the outer strip of webbing near the bottom of the bar assembly.

The upper attachment of the bar assembly 88 is defined between one of the pockets 84 and the upper end of the bar assembly. If it is desired to allow the rapid disconnection of the bar assembly 88 and the vest 86, then the upper snap male half 98 is not connected to the corresponding one of the snap female halves 102 which are positioned to face inwardly into each of the pockets 84. As shown in FIG. 5, the upper end of the bar assembly 88 abuts against the upper seam 104 defining one of the pockets 84, and thus vest loads are transferred to the bar assembly 88. If the wearer of the assembly 82 moves in such a way as to increase the distance between the vest and the belt, then the bar assembly 88 may be partially extracted from its pocket 84. If the vest is emergency doffed, then the bar assembly is entirely free to be separated from the vest. On the other hand, if it is desired to retain the connection between the vest and the bar assembly, then the bar assembly may be secured within the pocket by connecting the upper snap male half 98 with the corresponding snap female half 102 within the pocket. A release tab 106 is sewn adjacent each snap female half 102, and extends downwardly from each pocket. The release tab 106 can be pulled upon to assist a user in separating the snap female half from the snap male half to facilitate disconnection of the vest from the bar assembly.

The lower attachment of the bar assembly to the belt (not shown in FIGS. 4 and 5), is defined by a pocket belt mount 108, similar to the belt mount 66 disclosed above. The pocket belt mount 108 supports an upwardly opening pocket 110 on to a waist encircling belt. The pocket 110 receives the lower end of the bar assembly 88 and thus allows the loads carried by the bar assembly 88 to be transferred to the belt. The belt mount 108 may be provided with an adjustable buckle 112.

Figure 6B:
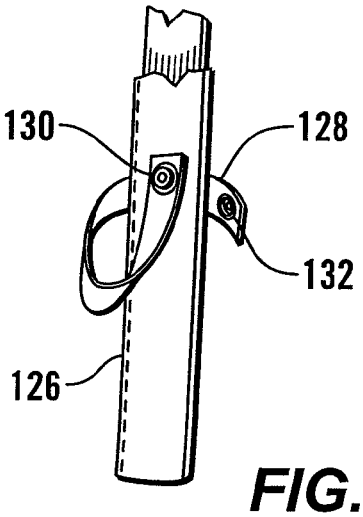
FIG. 6*b* is a fragmentary view of the support bar of FIG. 6, shown with the belt retaining strap in stowed position.
Figure 6A:
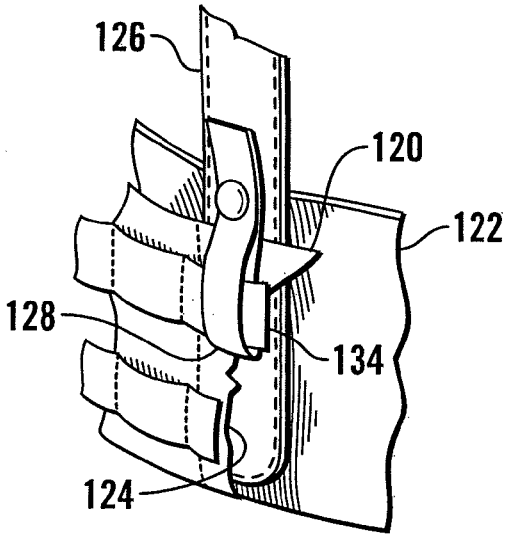
FIG. 6*a* is a fragmentary view, partially broken away in section, of the connection between a support bar and the belt of the load carrying assembly of FIG. 6.

An alternative embodiment load carrying assembly 114 is shown in FIGS. 6, 6*a*, and 6*b*. The load carrying assembly 114 has multiple downwardly opening pockets 116 similar to the assembly 82. The pockets 116 are sewn to the vest 117. The belt 118 may be secured by a snap plastic buckle 40. The waist encircling belt 118 has a flap 120 to which two strips of horizontal PALS webbing is connected. The flap 120 is separated from an exterior wall 122 of the belt 118 to define an upwardly opening pocket 124, as shown in FIG. 6*a*. The support assembly has two bar assemblies 126, one on each side of the vest 117. Each bar assembly 126 extends downwardly and is received within the pocket 124. A narrow belt retaining strap 128 is secured with a male snap half 130 to the bar assembly 126 facing outwardly. The free end of the belt retaining strap 128 is provided with a female snap half 132. Where connection between the belt 118 and the bar assembly 126 is acceptable, the belt retaining strap is passed into a PALS loop 134 and back up to be snapped on to the bar assembly 82, as shown in FIG. 6*a*. Where it is desired to avoid such a connection, the belt retaining strap may be looped behind the bar assembly, as shown in FIG. 6*b*, and then snapped onto itself without engaging the PALS loop 134.

Figure 7:
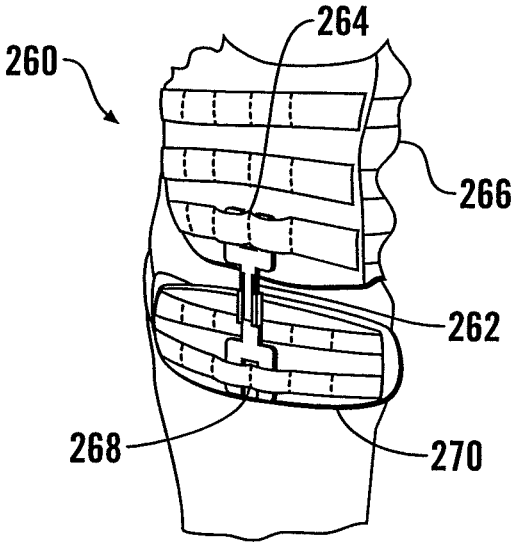
FIG. 7 is a perspective view of a soldier wearing an alternative embodiment load carrying assembly of this invention having multiple member support assemblies.
Figure 8:
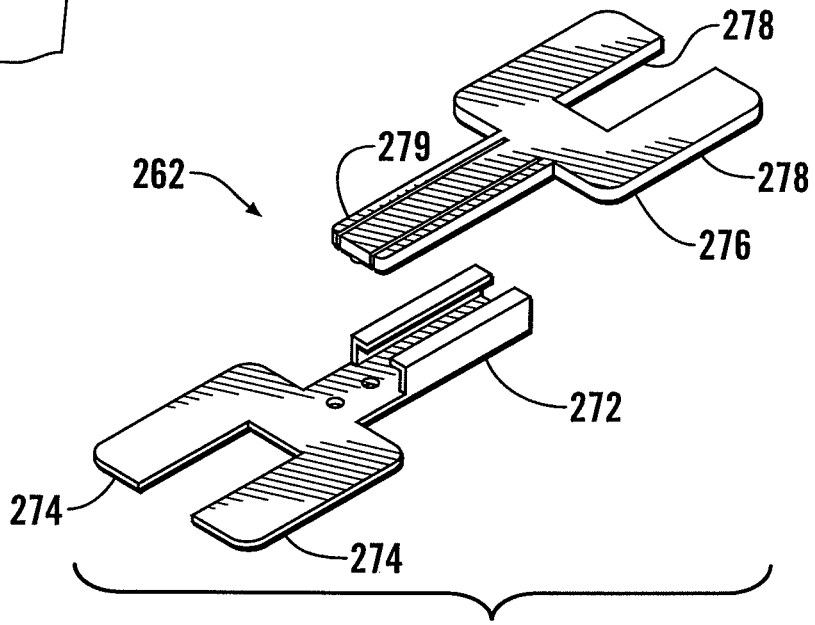
FIG. 8 is an exploded perspective view of one of the multiple member support assemblies of the assembly of FIG. 7.
Figure 9:
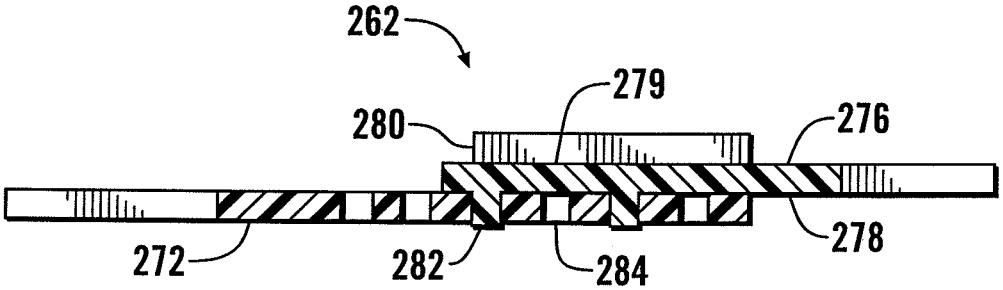
FIG. 9 is a cross-sectional view taken along the center line of one of the support assemblies of FIG. 7.

An alternative embodiment load carrying assembly 260 is shown in FIG. 7. The assembly 260 has two bar assemblies 262 which extend between the PALS loops 264 of a ballistic vest 266 and the PALS loops 268 of a belt 270. As shown in FIG. 8, each bar assembly 262 has a first segment 272 with two lower members 274 and a second segment 276 with two upper members 278. The lower members 274 are spaced to engage within two adjacent PALS loops 268 of the belt 270, and the upper members 278 are likewise spaced to engage within two adjacent PALS loops 264 of the ballistic vest 266. As shown in FIG. 9, the first segment 272 and the second segment 276 mate with each other to allow the vertical length of the bar assembly 262 to be adjusted, such as by sliding the body 279 of the second member within a channel 280 formed on the first member. Cylindrical projections 282 extend from the second member to engage within cylindrical openings 284 in the first member.

It is understood that the invention is not limited to the particular construction and arrangement of parts herein illustrated and described, but embraces all such modified forms thereof as come within the scope of the following claims.

I claim:

1. A load-carrying assembly for wearing by a wearer, the assembly comprising:

a vest having a rear section arranged for positioning to the rear of the wearer, a front section spaced frontwardly of the rear section arranged for positioning to the front of the wearer, and a left side section and a right side section which extend between the front section and the rear section, wherein top segments extend between the front section and the rear section to define a left arm hole above the left side section, and a right arm hole above the left side section;

a waist encircling belt separate from and beneath the vest, the belt having a front section arranged for positioning to the front of the wearer, a rear section arranged for positioning to the rear of the wearer, and a left side section and right side section which extend between the front section and the rear section for positioning on opposite sides of the wearer;

a first support assembly comprising a stiff first bar which extends between an upper attachment which is connected to the vest left side section below the left arm hole, and a lower attachment which is connected to the belt left side section; and a second support assembly comprising a stiff second bar which extends between an upper attachment which is connected to the vest right side section below the right arm hole, and a lower attachment which is connected to the belt right side section; and wherein the first bar and second bar have tops, and are flexibly coupled to the vest to allow the vest to pivot in the vicinity of each bar top, and where the first bar and second bar are selectively detachable from their respective assemblies, allowing the vest and belt to completely detach from one another and exist as two separate components.

2. The load-carrying assembly of claim 1 wherein the first support assembly first bar extends within a pocket defined between an outer material layer and an inner material layer, and wherein a strip of webbing is fastened to the outer material layer to define a plurality of first loops, and wherein the vest left side section further comprises a plurality of loops through which the first bar extends, and a cord extends between the first loops to define the upper attachment.

3. The load-carrying assembly of claim 1 further comprising a belt mount comprised of a strap which encircles and is connected to the belt, the belt mount having fixed thereto a first part of a two-part buckle assembly, and wherein a second part of the two-part buckle assembly is connected to a lower end of the first load-carrying assembly, the buckle assembly first part being releasably engaged with the buckle assembly second part to define the first support assembly lower attachment.

4. The load-carrying assembly of claim 3 wherein the belt mount further comprises a stiffening plate engaged between overlapping portions of the belt mount strap.

5. The load-carrying assembly of claim 1 wherein the vest has a first downwardly opening pocket, and wherein the first bar extends upwardly into the first downwardly opening pocket to define the upper attachment.

6. The load-carrying assembly of claim 5 wherein the first bar is enclosed between an outer layer of material and an inner layer of material, and wherein one-half of a two-part snap fastener is fixed to the outer layer of material, and wherein another half of the two-part snap fastener is fixed to portions of the vest which define the first downwardly opening pocket, such that the one half and the other half of the two-part snap fastener engage within the first downwardly opening pocket to retain the first bar therein.

7. The load-carrying assembly of claim 6 wherein the first downwardly opening pocket is defined by an exterior wall, and further comprising a release tab fastened to the exterior wall, the release tab being operable to separate the halves of the two-part snap fastener when the first bar is engaged within the first downwardly opening pocket.

8. The load-carrying assembly of claim 5 further comprising a second downwardly opening pocket positioned above the first downwardly opening pocket on the vest, the second downwardly opening pocket being dimensioned to receive portions of the first bar therein to thereby permit adjustment of the spacing between the vest and the belt.

9. The load-carrying assembly of claim 1 wherein the belt has an upwardly opening pocket, and wherein the first bar extends downwardly into the upwardly opening pocket to define the lower attachment.

10. The assembly of claim 9 wherein the belt has a flap to which a strip of horizontal webbing is connected, portions of the webbing defining a loop, and wherein the flap is separated from an exterior wall of the belt to define the at least one upwardly opening pocket, and wherein a belt retaining strap having one half of a snap fastener is secured to the first bar assembly with the one half of the snap fastener facing outwardly, wherein the belt retaining strap has a free end with a mating half of the snap fastener thereon, such that where connection between the belt and the bar assembly is acceptable, the belt retaining strap is passed into the horizontal webbing loop, and back up to be snapped on to the bar assembly, and where it is desired to avoid such a connection, the belt retaining strap may be looped behind the bar assembly, and then snapped onto itself without engaging the horizontal webbing loop.

11. A load-carrying assembly for wearing by a wearer, the assembly comprising:

a vest having a rear section arranged for positioning to the rear of the wearer, a front section spaced frontwardly of the rear section arranged for positioning to the front of the wearer, and a left side section and a right side section which extend between the front section and the rear section, wherein top segments extend between the front section and the rear section to define a left arm hole above the left side section, and a right arm hole above the left side section;

a downwardly opening left pocket attached to the left side section of the vest below the left arm hole;

a downwardly opening right pocket attached to the right side section of the vest below the right arm hole;

a waist encircling belt separate from and beneath the vest, the belt having a front section arranged for positioning to the front of the wearer, a rear section arranged for positioning to the rear of the wearer, and a left side section and right side section which extend between the front section and the rear section for positioning on opposite sides of the wearer;

a first support assembly comprising a stiff first bar which extends into the left pocket defining an upper attachment which is flexibly connected to the vest left side section below the left arm hole, and a lower attachment which is connected to the belt left side section; and a second support assembly comprising a stiff second bar which extends into the right pocket defining an upper attachment which is flexibly connected to the vest right side section below the right arm hole, and a lower attachment which is connected to the belt right side section.

12. The load-carrying assembly of claim 11 wherein the belt has an upwardly opening pocket, and wherein the first bar extends downwardly into the upwardly opening pocket to define the lower attachment.

13. The assembly of claim 12 wherein the belt has a flap to which a strip of horizontal webbing is connected, portions of the webbing defining a series of PALS loops, and wherein the flap is separated from an exterior wall of the belt to define the at least one upwardly opening pocket, and wherein a belt retaining strap having one half of a snap fastener is secured to the first bar assembly with the one half of the snap fastener facing outwardly, wherein the belt retaining strap has a free end with a mating half of the snap fastener thereon, such that where connection between the belt and the bar assembly is acceptable, the belt retaining strap is passed into one of the series of PALS loops, and back up to be snapped on to the bar assembly, and where it is desired to avoid such a connection, the belt retaining strap may be looped behind the bar assembly, and then snapped onto itself without engaging the said one of the series of PALS loops.

14. The load-carrying assembly of claim 11 wherein the first bar is enclosed between an outer layer of material and an inner layer of material, and wherein one-half of a two-part snap fastener is fixed to the outer layer of material, and wherein another half of the two-part snap fastener is fixed to portions of the vest which define the left downwardly opening pocket, such that the one half and the other half of the two-part snap fastener engage within the left downwardly opening pocket to retain the first bar therein.

15. The load-carrying assembly of claim 14 wherein the left downwardly opening pocket is defined by an exterior wall, and further comprising a release tab fastened to the exterior wall, the release tab being operable to separate the halves of the two-part snap fastener when the first bar is engaged within the first downwardly opening pocket.

16. The load-carrying assembly of claim 15 further comprising a second downwardly opening pocket positioned above the left downwardly opening pocket on the vest, the second downwardly opening pocket being dimensioned to receive portions of the first bar therein to thereby permit adjustment of the spacing between the vest and the belt.

* * * * *